US012653306B2

(12) United States Patent
Ponder

(10) Patent No.: US 12,653,306 B2
(45) Date of Patent: Jun. 16, 2026

(54) CONVERTIBLE BAR AND TABLE ASSEMBLY

(71) Applicant: Darryl Ponder, Chicago, IL (US)

(72) Inventor: Darryl Ponder, Chicago, IL (US)

( * ) Notice: Subject to any disclaimer, the term of this patent is extended or adjusted under 35 U.S.C. 154(b) by 77 days.

(21) Appl. No.: 18/955,566

(22) Filed: Nov. 21, 2024

(65) Prior Publication Data

US 2026/0137205 A1 May 21, 2026

(51) Int. Cl.
*A47B 69/00* (2006.01)
*A47B 81/04* (2006.01)
*A47B 83/04* (2006.01)

(52) U.S. Cl.
CPC ..... *A47B 69/00* (2013.01); *A47B 81/04* (2013.01); *A47B 83/045* (2013.01); *A47B 2220/0002* (2013.01); *A47B 2220/0077* (2013.01)

(58) Field of Classification Search
CPC ... A47B 69/00; A47B 85/08; A47B 2031/002; A47B 2031/008; A47B 31/04; A47B 46/00; A47B 73/00; A47B 73/004; A47B 81/04; A47B 83/045; A47B 2220/0002; A47B 2220/0077
See application file for complete search history.

(56) References Cited

U.S. PATENT DOCUMENTS 1,038,974 A * 9/1912 Schulz ..... A47B 85/08 312/240
1,203,202 A * 10/1916 Kinsella ..... A47G 23/025 248/141
1,543,980 A * 6/1925 Blood ..... A47B 77/02 312/316
1,994,857 A * 3/1935 Krause ..... A47B 69/00 206/427
2,122,042 A 6/1938 Mattucci
2,472,722 A 6/1949 Newstead
2,488,035 A * 11/1949 Pistone ..... A47B 81/04 312/304
2,604,373 A 7/1952 Beriou
3,013,852 A * 12/1961 Rockola ..... A47B 69/00 362/132

(Continued)

FOREIGN PATENT DOCUMENTS

DE 29914016 U1 * 11/1999 ..... A47B 69/00
FR 920586 A * 4/1947 ..... A47B 69/00

(Continued)

*Primary Examiner* — Andrew Roersma

(57) ABSTRACT

A convertible bar and table assembly for provision of coffee table and bar functions includes a housing which is elongate cuboid shaped. A first plate is hingedly attached to a rear is hingable between stowed configuration, wherein the first plate covers an opening in a top of the housing and a deployed configuration, wherein it extends from the housing substantially coplanarly with the rear. A stemware rack, which is pivotally attached to the first plate distal from the rear, retains items of stemware so that they pivot concurrently with hinging of the first plate. A second plate, which is attached to and which extends perpendicularly from the first plate proximate to the rear of the housing, substantially covers the opening with the first plate in the deployed configuration. Bulbs attached to the stemware rack selectively illuminate the items of stemware.

18 Claims, 7 Drawing Sheets

(56) References Cited

U.S. PATENT DOCUMENTS

| | | | | | |
|---|---|---|---|---|---|
| 3,087,767 | A * | 4/1963 | Schell | A47B 85/08 | 312/316 |
| 3,131,011 | A * | 4/1964 | Rittenberry | A47B 69/00 | 211/74 |
| 3,288,545 | A * | 11/1966 | Benne | A47F 3/06 | 312/193 |
| 3,695,742 | A | 10/1972 | Allen | | |
| 3,985,410 | A | 10/1976 | Young | | |
| 5,281,016 | A * | 1/1994 | Brague | A47B 43/00 | 312/258 |
| 6,543,436 | B2 * | 4/2003 | Montgomery | F24C 15/18 | 126/38 |
| 6,836,910 | B2 * | 1/2005 | Cawthon | E03C 1/326 | 4/654 |
| 7,131,545 | B1 * | 11/2006 | Grogan | A47G 23/0208 | 211/113 |
| 7,195,125 | B1 * | 3/2007 | Wolseth | A47B 73/004 | 211/74 |
| 7,722,204 | B1 * | 5/2010 | Sandberg | F25D 27/005 | 362/94 |
| 7,828,398 | B1 | 11/2010 | Burnick | | |
| D677,074 | S | 3/2013 | Olson | | |
| 10,203,154 | B1 * | 2/2019 | Wyatt | F21V 23/04 | |
| 2003/0038138 | A1 * | 2/2003 | Komurke | A45C 11/20 | 220/592.2 |
| 2016/0166070 | A1 * | 6/2016 | Golic | A47C 13/00 | 220/592.2 |
| 2017/0129097 | A1 * | 5/2017 | Engvall | A45C 11/20 | |
| 2020/0187615 | A1 * | 6/2020 | Hockaday, Jr. | A45C 15/06 | |
| 2020/0315343 | A1 * | 10/2020 | Lynch | A47B 69/00 | |

FOREIGN PATENT DOCUMENTS

| | | | | |
|---|---|---|---|---|
| GB | 194853 | A * | 3/1923 | A47B 69/00 |
| GB | 389965 | | 3/1933 | |
| GB | 531414 | | 1/1941 | |
| GB | 714346 | A * | 8/1954 | A47B 69/00 |
| GB | 1237667 | A * | 6/1971 | A47B 69/00 |

* cited by examiner

CONVERTIBLE BAR AND TABLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to multifunctional furniture devices and more particularly pertains to a new multifunctional furniture device for provision of coffee table and bar functions.

(2) Description of Related Art including information disclosed under 37 CFR 1.97 and 1.98

The prior art relates to multifunctional furniture devices but does not teach a multifunctional furniture device, which can function as a coffee table and a bar, and which has the combination of features disclosed herein.

BRIEF SUMMARY OF THE INVENTION

An embodiment of the disclosure meets the needs presented above by generally comprising a housing, which defines an interior space and which is elongate cuboid shaped. The housing is configured to function as a coffee table. A top of the housing has an opening positioned therein. A first plate is hingedly attached to a rear of the housing adjacent to the top. The first plate is hingable between a stowed configuration and a deployed configuration, wherein the first plate covers the opening and extends from the housing substantially coplanarly with the rear, respectively. A stemware rack, which is pivotally attached to the first plate distal from the rear, is configured for insertion of bases of items of stemware so that the items of stemware pivot concurrently with hinging of the first plate. A second plate is attached to and extends perpendicularly from the first plate proximate to the rear of the housing. The second plate substantially covers the opening with the first plate in the deployed configuration. A plurality of bulbs is attached to the stemware rack and is configured to selectively illuminate the items of stemware.

Another embodiment of the disclosure includes a convertible bar and table system, which comprises the convertible bar and table assembly, as per the disclosure above and having display rack attached to the second plate and a tilt out cabinet pivotally attached to the housing. A plurality of articles of stemware is positioned in slots of the stemware rack, at least one bottle is attached to the display rack, and a plurality of bottles is stowed in the tilt out cabinet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
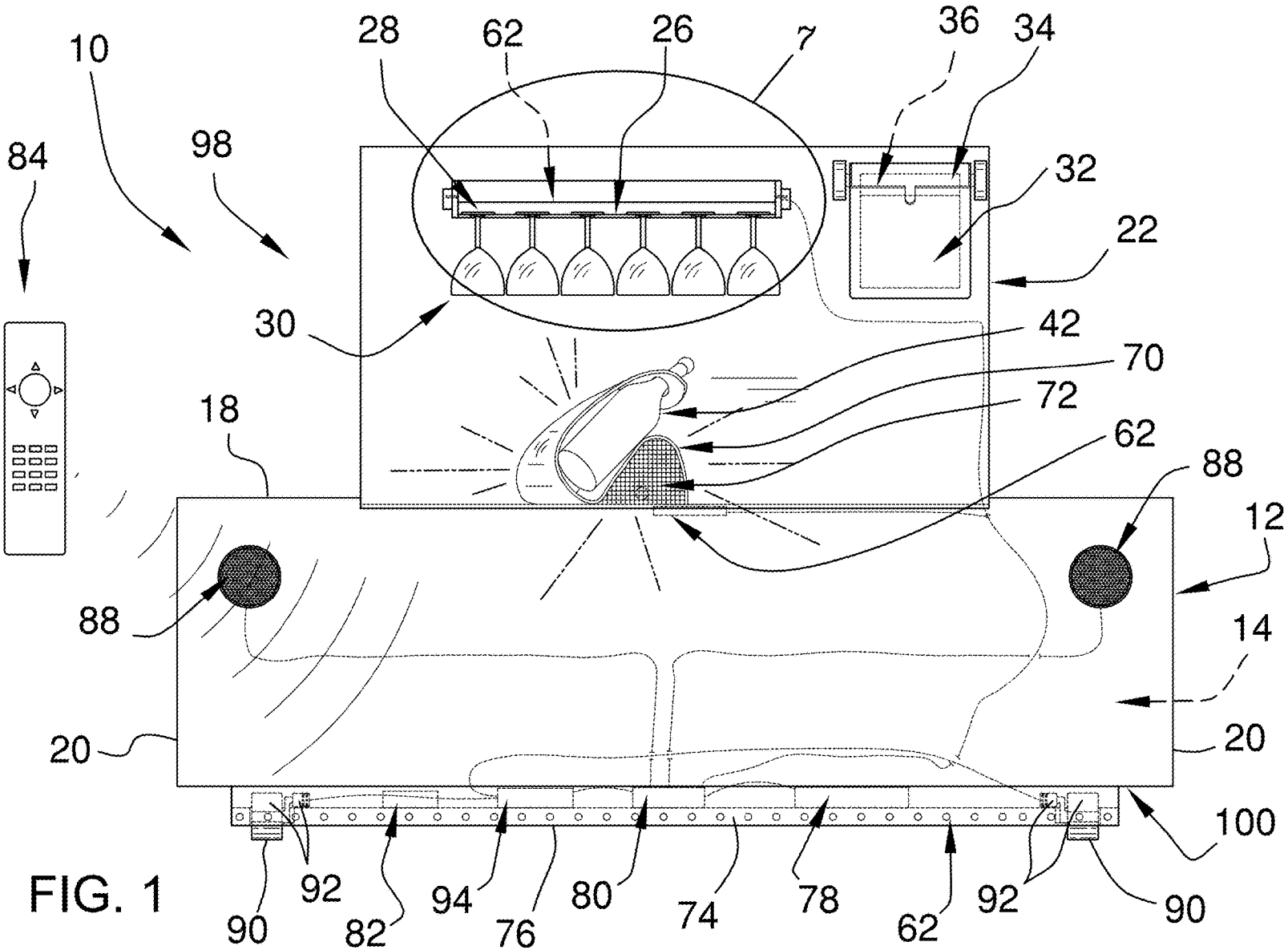
FIG. 1 is a front view of a convertible bar and table assembly according to an embodiment of the disclosure.

With reference now to the drawings, and in particular to FIGS. 1 through 6 thereof, a new multifunctional furniture device embodying the principles and concepts of an embodiment of the disclosure and generally designated by the reference numeral 10 will be described.

Figure 2:
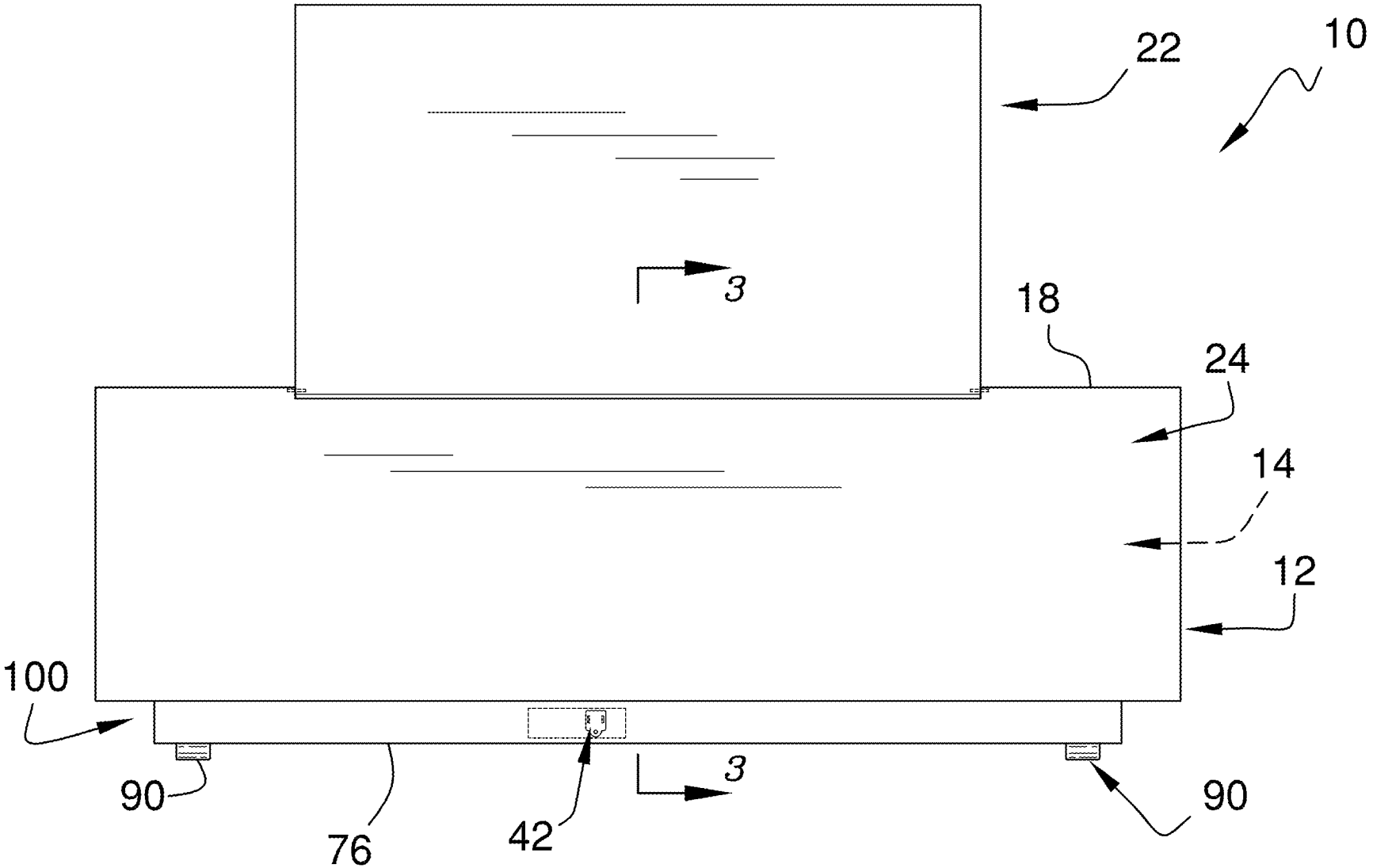
FIG. 2 is a rear view of an embodiment of the disclosure.
Figure 3:
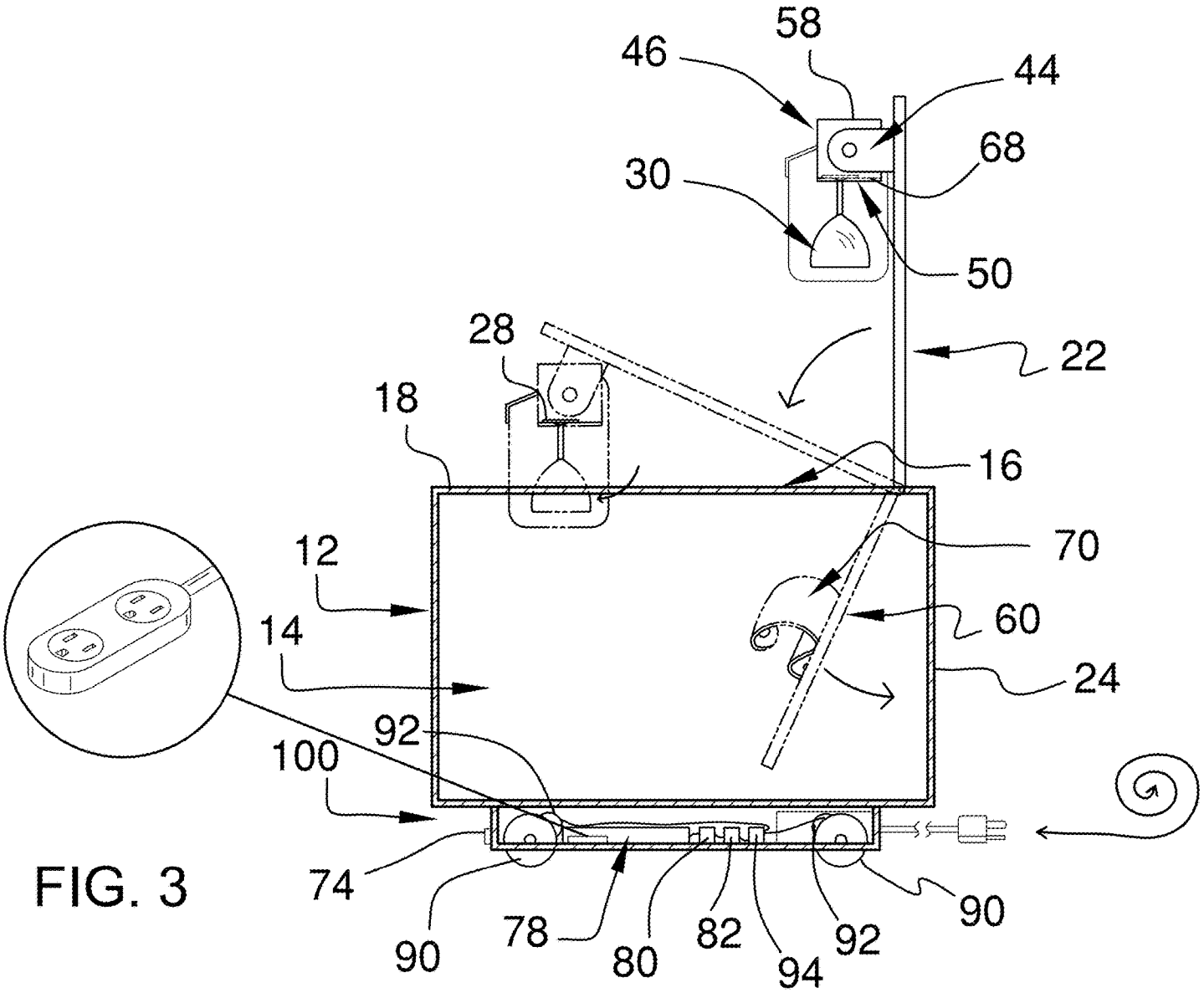
FIG. 3 is a cross-sectional view of an embodiment of the disclosure.
Figure 5:
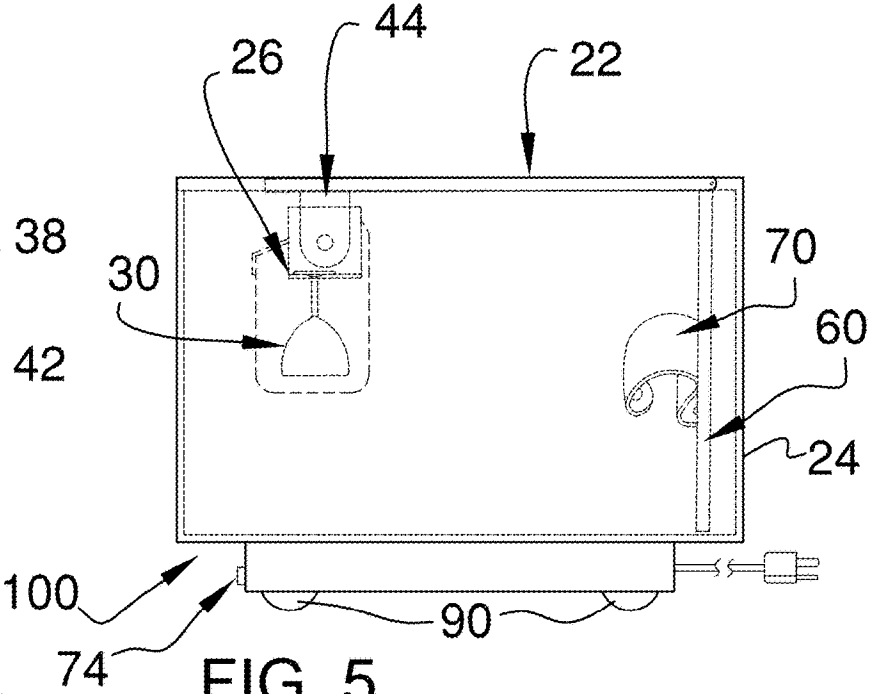
FIG. 5 is a right side view of an embodiment of the disclosure.
Figure 4:
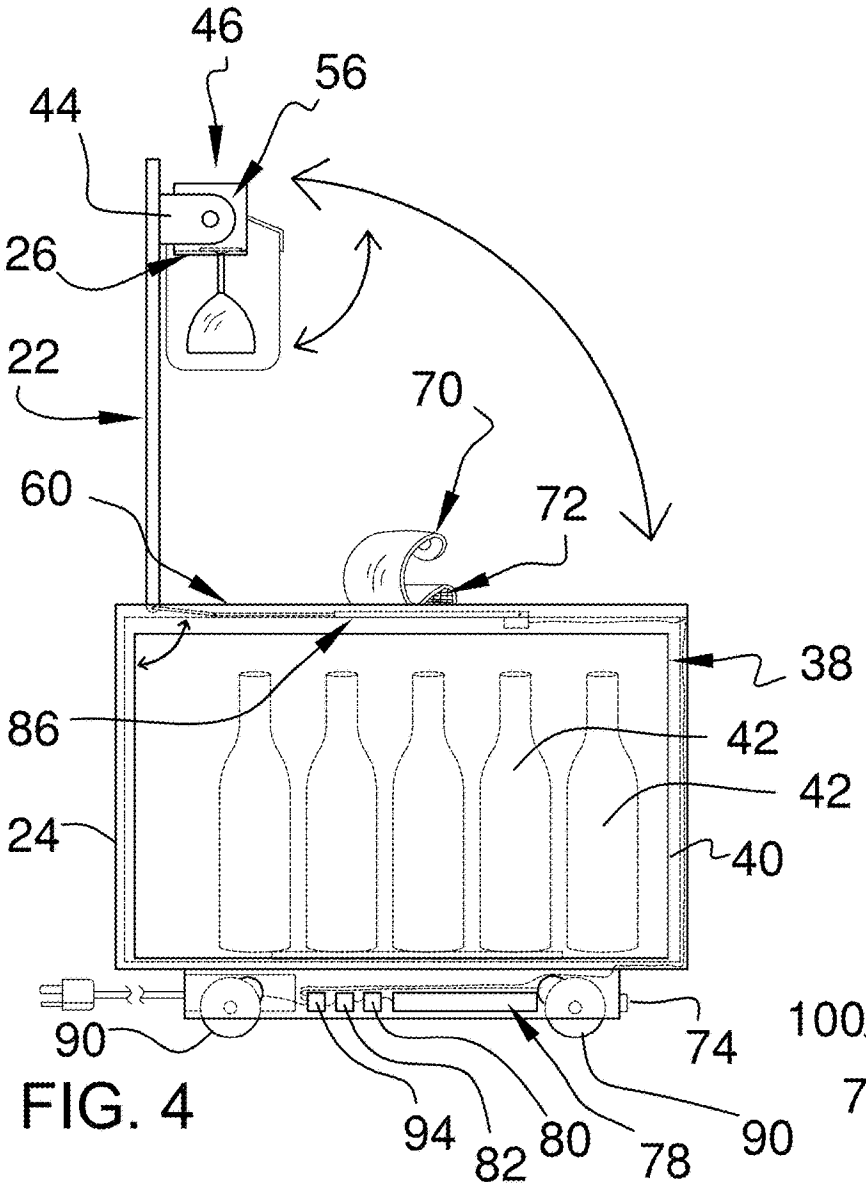
FIG. 4 is a left side view of an embodiment of the disclosure.

As best illustrated in FIGS. 1 through 6, the convertible bar and table assembly 10 generally comprises a housing 12, which defines an interior space 14 and which is elongate cuboid shaped. The housing 12 is configured to function as a coffee table. An opening 16 in a top 18 of the housing 12 is centered between opposed ends 20 of the housing 12. A first plate 22 is hingedly attached to a rear 24 of the housing 12 adjacent to the top 18. The first plate 22 is hingable between a stowed configuration, as is shown in FIG. 5, wherein the first plate 22 covers the opening 16, and a deployed configuration, as is shown in FIG. 4, wherein the first plate 22 extends from the housing 12 substantially coplanarly with the rear 24.

Figure 7:
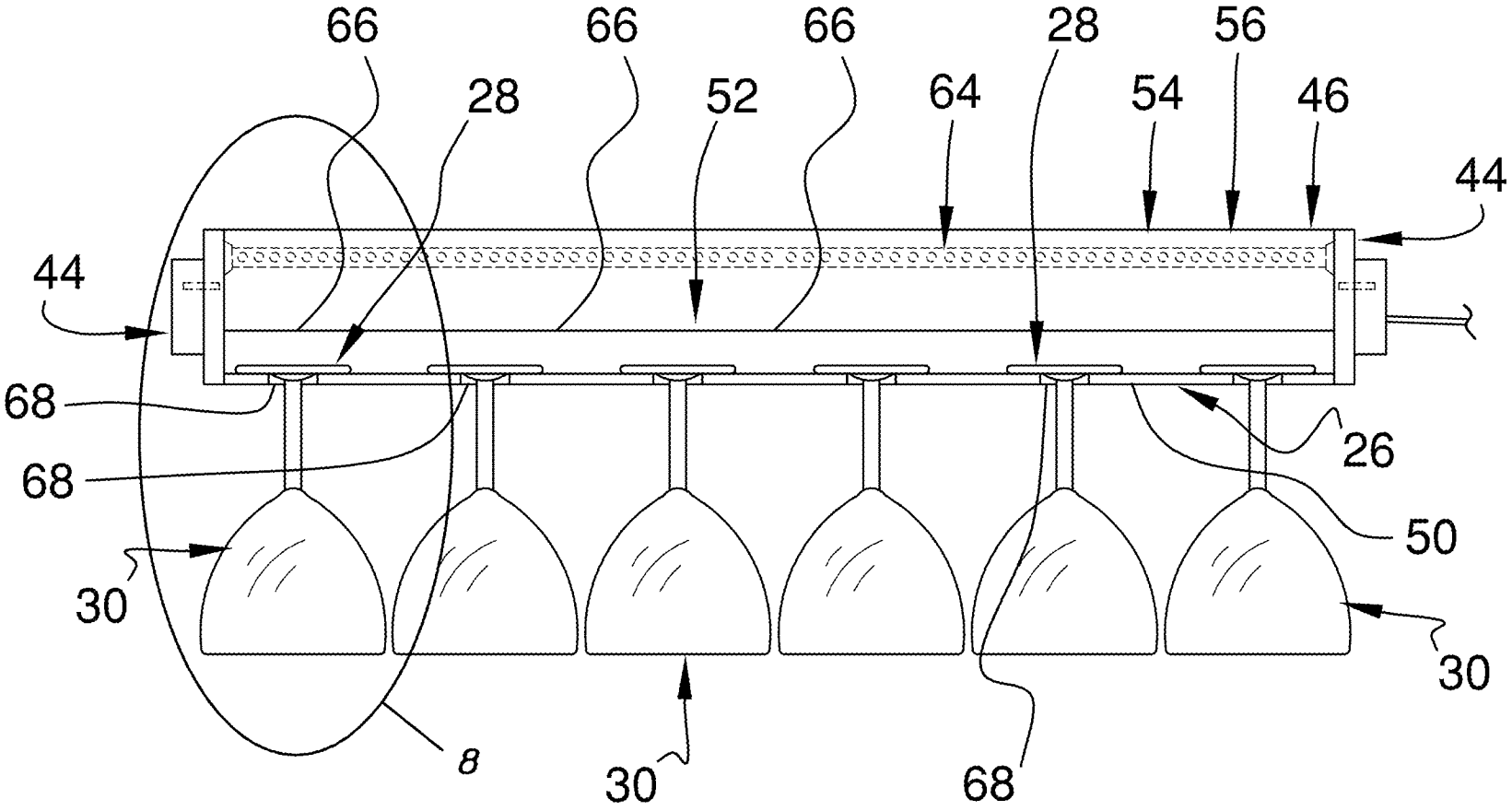
FIG. 7 is a detail view of an embodiment of the disclosure.
Figure 8:
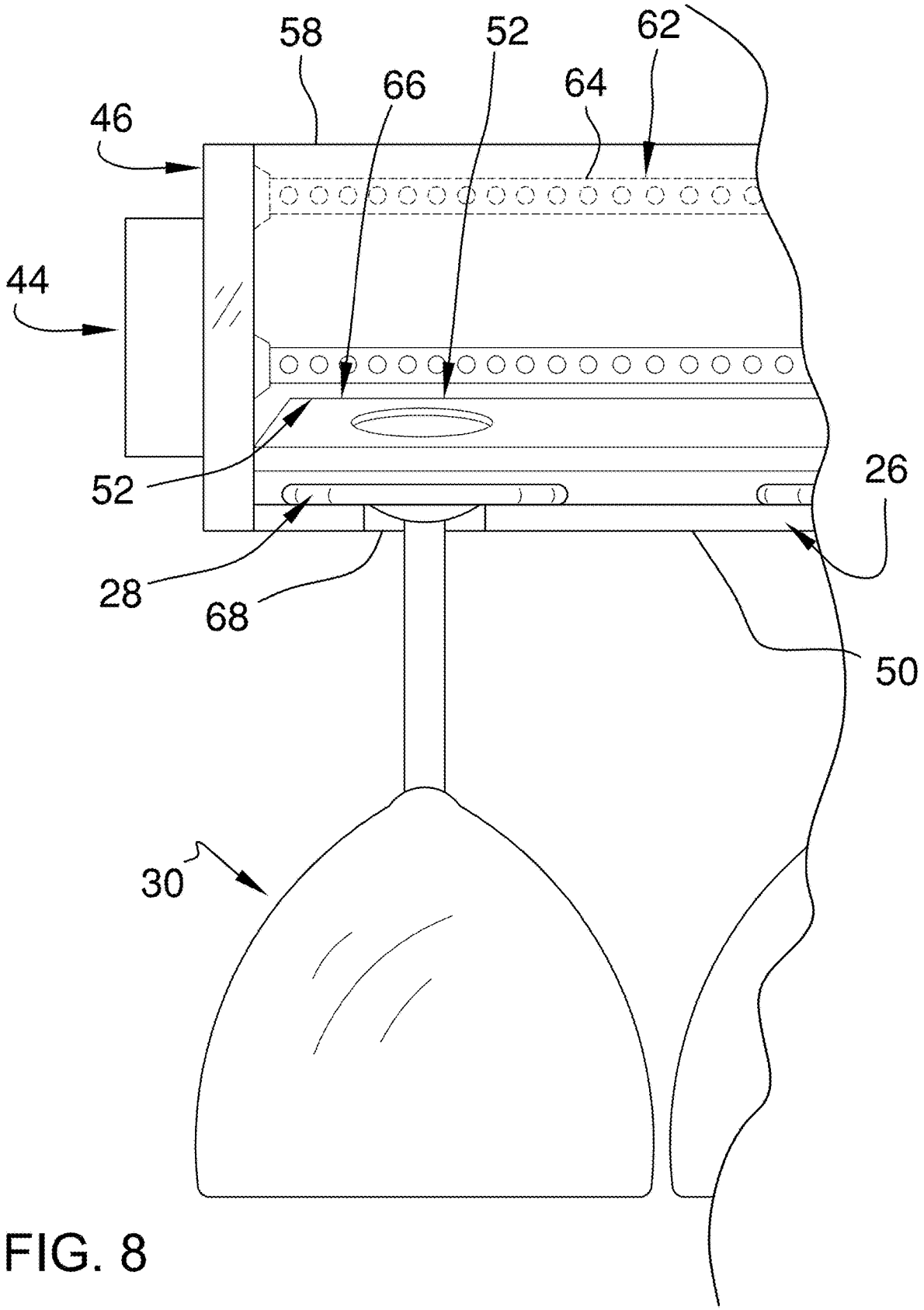
FIG. 8 is a detail view of an embodiment of the disclosure.

A stemware rack 26, which is pivotally attached to the first plate 22 distal from the rear 24, is configured for insertion of bases 28 of items of stemware 30 so that the items of stemware 30 pivot concurrently with hinging of the first plate 22. As is shown in FIG. 7, a pair of arms 44 is attached to the first plate 22 distal from the rear 24. An elongate housing 46 is rotationally attached to and extends between the arms 44. A lower facet 50 of the elongate housing 46 comprises the stemware rack 26. A panel 52 is attached to the elongate housing 46 and defines a compartment 54 within an internal space 56 defined by the elongate housing 46. The compartment 54 extends along an upper facet 58 of the elongate housing 46.

The convertible bar and table assembly 10 may include a bucket 32, which is attached to the first plate 22 distal from the rear 24 and which is configured to hold ice with the first plate 22 being positioned in the deployed configuration. The present invention anticipates a lid 34 hingedly attached to the bucket 32 to close an open top 36 of the bucket 32. The present invention also anticipate the lid 34 being fixedly and sealably attachable to the bucket 32 so that the bucket 32 can retain ice and water when the first plate 22 is in the stowed configuration. The bucket 32 also may be fitted with a drain (not shown) to allow water to be drained from the bucket 32. Additionally anticipated by the present invention is the bucket 32 being removably attachable to the first plate 22, such as by means of hooks, brackets, or the like, thereby allowing a user to take the bucket 32 to an ice source to be filled and to a sink to empty the bucket 32 of water.

Figure 6:
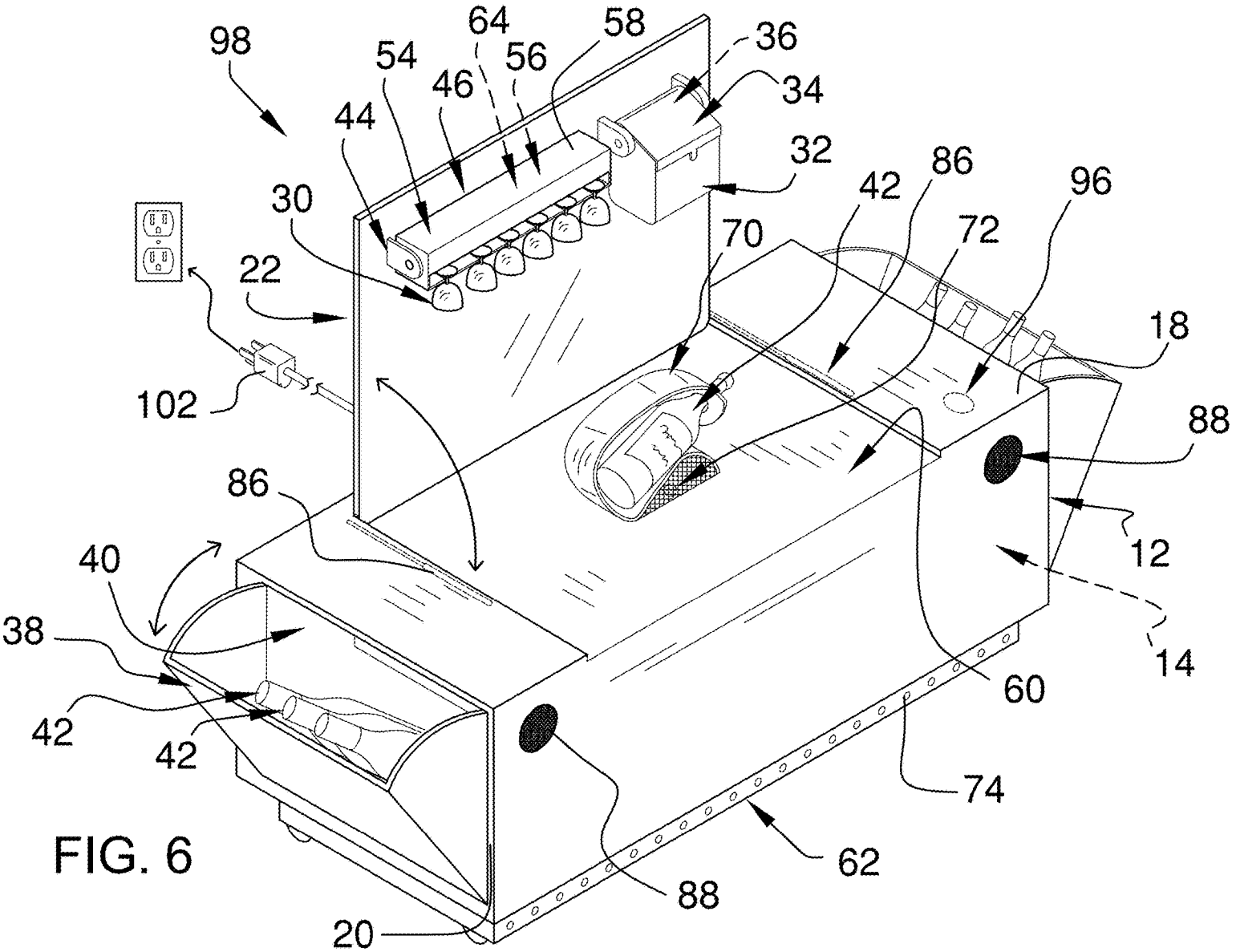
FIG. 6 is an isometric perspective view of an embodiment of the disclosure.

A tilt out cabinet 38 is pivotally attached to the housing 12 and is selectively positionable in a stowed position, as is shown in FIG. 2, wherein the tilt out cabinet 38 is positioned within the interior space 14. The tilt out cabinet 38 also is positionable in a deployed position, as is shown in FIG. 6, wherein the tilt out cabinet 38 extends angularly from a cutout 40 positioned in a respective opposed end 20 of the housing 12. The tilt out cabinet 38 is configured to store a plurality of bottles 42. The present invention also anticipates a pullout cabinet on rails (not shown) in place of the tilt out cabinet 38.

A second plate 60 is attached to and extends perpendicularly from the first plate 22 proximate to the rear 24 of the housing 12. The second plate 60 substantially covers the opening 16 with the first plate 22 in the deployed configuration. As is shown in FIG. 5, with the first plate 22 in the stowed configuration, the second plate 60 abuts the rear 24 of the housing 12. A plurality of bulbs 62 is attached to the stemware rack 26 and is configured to selectively illuminate the items of stemware 30.

The plurality of bulbs 62 comprises a light emitting diode tube 64, which is positioned in the compartment 54. The light emitting diode tube 64 is configured to emit light through a plurality of holes 66 that is positioned in the panel 52. Each hole 66 is aligned with a respective slot 68 of the stemware rack 26 so that light passing through the hole 66 illuminates an item of stemware 30 that is positioned in the respective slot 68. While six slots 68 are shown in the Figures, the present invention anticipates the stemware rack 26 comprising from two to twelve slots 68. Additionally, while the Figures show each slot 68 being configured to retain one item of stemware 30, the present invention anticipates each slot being configured to retain two or more items of stemware 30.

As is shown in FIG. 1, the convertible bar and table assembly 10 may comprise a display rack 70, which is attached to the second plate 60 and which is configured to display at least one bottle 42. A large number of configurations of the display rack 70 are possible and are anticipated by the present invention. FIG. 1 depicts a display rack 70 of a sinuous design that is intended to hold and display a single bottle 42. Many other designs will be obvious to those skilled in the art of displaying bottles 42, and in particular bottles 42 that contain wine. Such display racks 70 also may hold and display more than one bottle 42. The plurality of bulbs 62 also comprises display light emitting diodes 72, which are attached to the display rack 70. The display light emitting diodes 72 are configured to project light upwardly to illuminate the bottle 42 that is positioned in the display rack 70. Some or all of the display rack 70 may comprise transparent or translucent elastomer, such as polyacrylic, to allow light to pass through to the bottle 42 and other parts of the display rack 70.

The plurality of bulbs 62 also comprises a light emitting diode strip 74, which is attached to the housing 12 and which is positioned in a recess 100 that extends circumferentially around the housing 12 adjacent to a bottom 76 of the housing 12. The present invention also anticipates the plurality of bulbs 62 comprising bulbs 62 positioned in tilt out cabinet 38.

A battery 78, a microprocessor 80, and a transceiver 82 are attached to the housing 12 and are positioned in the interior space 14. As will be apparent to those skilled in the art of electronics, the convertible bar and table assembly 10 also may be powered by means of a power cord 102, as is depicted in FIG. 6. The microprocessor 80 is operationally engaged to the battery 78, the transceiver 82, and the plurality of bulbs 62. The convertible bar and table assembly 10 also comprises a remote control unit 84, which is communicatively engaged to the microprocessor 80 via the transceiver 82. The remote control unit 84 is configured to communicate lighting commands to the microprocessor 80 to selectively power respective bulbs 62 of the plurality of bulbs 62, thereby allowing the user to select which bulbs 62 to illuminate for a particular mood, event, or the like.

An actuator 86 is attached to the housing 12, is positioned in the interior space 14, and is operationally engaged to the first plate 22. The remote control unit 84 is configured to allow a user to communicate positional commands to the microprocessor 80 to selectively actuate the actuator 86 to motivate the first plate 22 between the stowed configuration and the deployed configuration.

The convertible bar and table assembly 10 also comprises a plurality of speakers 88, which is attached to the housing 12 and which is operationally engaged to the microprocessor 80. The present invention anticipates the plurality of bulbs 62 comprising additional light emitting diode strips 74 (not shown) extending circumferentially around the speakers 88. The remote control unit 84 is configured to communicate volume commands and selection commands to the microprocessor 80 to control a volume of the plurality of speakers 88 and to select an audio signal to be broadcast by the plurality of speakers 88. The present invention anticipate the speakers 88 being utilized as a standalone means of broadcasting audio signals or being incorporated into a speaker system. The plurality of speakers 88 may comprise two speakers 88, as is shown in FIG. 1, or other number of speakers 88, such as, but not limited to, three speakers 88, four speakers 88, or six speakers 88. The plurality of speakers 88 may comprise a subwoofer (not shown). While the speakers 88 are shown in FIG. 1 as being wired to the microprocessor 80, the present invention also anticipates the speakers being wirelessly engaged to the microprocessor 80 or configured to be wirelessly engaged to an electronic device of the user.

A plurality of wheels 90 is attached to the bottom 76 of the housing 12, thereby enabling a user to easily roll the housing 12 upon the plurality of wheels 90 to position the housing 12 on a surface. The convertible bar and table assembly 10 also may comprise a plurality of motors 92 and a controller 94, which are attached to the housing 12 and which are positioned in the interior space 14. The present invention anticipates the motors 92 comprising stepper motors, servomotors, or the like. Each motor 92 is operationally engaged to a respective wheel 90. The controller 94 is operationally engaged to the microprocessor 80 and to the plurality of motors 92. The remote control unit 84 is configured to allow a user to communicate directional commands to the microprocessor 80, positioning the microprocessor 80 to actuate the controller 94 to selectively actuate the motors 92 to position the housing 12 on the surface.

As is shown in FIG. 6, a wireless phone charger 96 is attached to the top 18 of the housing 12 and is operationally engaged to the battery 78, thereby enabling the user to wirelessly charge a phone. The present invention also anticipates one or more outlets 42, as is shown in FIG. 3, Universal Serial Bus ports, or the like, which would be attached to the housing 12 and operationally engaged to the battery 78, thereby enabling the user to charge a phone lacking wireless charging capability. The outlets 42 also could be used to power or to charge other devices, such as music players, ear buds, or the like.

The present invention also anticipates a convertible bar and table system 98, which comprises the convertible bar and table assembly 10, as per the specification above. A plurality of articles of stemware 30 is positioned in the slots 68 of the stemware rack 26, at least one bottle 42 is attached to the display rack 70, and a plurality of bottles 42 is stowed in the tilt out cabinet 38.

In use, the housing 12 would be positioned as desired in a room, typically in front of a couch, sofa, loveseat, bench, or the like, where it would be utilized as a coffee table. At the user's discretion, the remote control unit 84 can be used to convert the convertible bar and table assembly 10 from a coffee table into a bar by having the actuator 86 raise the first plate 22 to the deployed configuration. The remote control unit 84 also allows the user to select audio files, control illumination provided by the bulbs 62, and if needed, to reposition the housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A convertible bar and table assembly comprising:

a housing defining an interior space, the housing being elongate cuboid shaped, wherein the housing is configured to function as a coffee table, a top of the housing having an opening positioned therein;

a first plate hingedly attached to a rear of the housing adjacent to the top, such that the first plate is hingable between a stowed configuration, wherein the first plate covers the opening, and a deployed configuration, wherein the first plate extends from the housing substantially coplanarly with the rear;

a stemware rack pivotally attached to the first plate distal from the rear, wherein the stemware rack is configured for insertion of bases of items of stemware, such that the items of stemware pivot concurrently with hinging of the first plate;

a second plate attached to and extending perpendicularly from the first plate proximate to the rear of the housing, such that the second plate substantially covers the opening with the first plate in the deployed configuration; and a plurality of bulbs attached to the stemware rack and being configured to selectively illuminate the items of stemware.

2. The convertible bar and table assembly of claim 1, wherein the opening is centered between opposed ends of the housing.

3. The convertible bar and table assembly of claim 2, further including a bucket attached to the first plate distal from the rear and being configured to hold ice with the first plate being positioned in the deployed configuration.

4. The convertible bar and table assembly of claim 3, further including a lid hingedly attached to the bucket to close an open top of the bucket.

5. The convertible bar and table assembly of claim 1, further including:

a pair of arms attached to the first plate distal from the rear:

an elongate housing rotationally attached to and extending between the arms of the pair of arms, a lower facet of the elongate housing comprising the stemware rack; and a panel attached to the elongate housing and defining a compartment within an internal space defined by the elongate housing, the compartment extending along an upper facet of the elongate housing.

6. The convertible bar and table assembly of claim 5, wherein the plurality of bulbs comprises a light emitting diode tube positioned in the compartment, wherein the light emitting diode tube is configured to emit light through a plurality of holes positioned in the panel, each hole of the plurality of holes being aligned with a respective slot of the stemware rack, such that light passing through the hole illuminates an item of stemware positioned in the respective slot.

7. The convertible bar and table assembly of claim 1, further including a display rack attached to the second plate and being configured to display at least one bottle.

8. The convertible bar and table assembly of claim 7, wherein the plurality of bulbs comprises display light emitting diodes attached to the second plate beneath the display rack, wherein the display light emitting diodes are configured to project light upwardly to illuminate the bottle positioned in the display rack.

9. The convertible bar and table assembly of claim 1, wherein the plurality of bulbs comprises a light emitting diode strip attached to the housing and positioned in a recess extending circumferentially around the housing adjacent to a bottom of the housing.

10. The convertible bar and table assembly of claim 1, further including a tilt out cabinet pivotally attached to the housing, such that the tilt out cabinet is selectively positionable in a stowed position, wherein the tilt out cabinet is positioned within the interior space, and a deployed position, wherein the tilt out cabinet extends angularly from a cutout positioned in a respective opposed end of the housing, wherein the tilt out cabinet is configured to store a plurality of bottles.

11. The convertible bar and table assembly of claim 1, further including:

an actuator attached to the housing, positioned in the interior space, and operationally engaged to the first plate;

a battery attached to the housing and positioned in the interior space;

a transceiver attached to the housing and positioned in the interior space;

a microprocessor attached to the housing, positioned in the interior space, and being operationally engaged to the battery and the to selectively motivate the first plate between the stowed configuration and the deployed configuration; and a remote control unit communicatively engaged to the microprocessor via the transceiver and being configured to allow a user to communicate positional commands to the microprocessor to selectively actuate the actuator to motivate the first plate between the stowed configuration and the deployed configuration.

12. The convertible bar and table assembly of claim 1, further including:

a battery attached to the housing and positioned in the interior space;

a transceiver attached to the housing and positioned in the interior space;

a microprocessor attached to the housing, positioned in the interior space, and being operationally engaged to the battery and the plurality of bulbs, wherein the transceiver is configured to receive an audio signal, positioning the microprocessor to actuate the plurality of speakers to broadcast the audio signal; and a remote control unit communicatively engaged to the microprocessor via the transceiver and being configured to allow a user to communicate lighting commands to the microprocessor to selectively power respective bulbs of the plurality of bulbs.

13. The convertible bar and table assembly of claim 1, further including:

a battery attached to the housing and positioned in the interior space;

a plurality of speakers attached to the housing;

a transceiver attached to the housing and positioned in the interior space; wherein the transceiver is configured to receive an audio signal; and a microprocessor attached to the housing, positioned in the interior space, and being operationally engaged to the battery, the plurality of speakers, and the transceiver; and a remote control unit communicatively engaged to the microprocessor via the transceiver and being configured to allow a user to communicate volume commands and selection commands to the microprocessor to control a volume of the plurality of speakers and to select an audio signal to be broadcast by the plurality of speakers.

14. The convertible bar and table assembly of claim 1, further including a plurality of wheels attached to the bottom of the housing, such that the housing is rollable upon the plurality of wheels to position the housing on a surface.

15. The convertible bar and table assembly of claim 14, further including:

a battery attached to the housing and positioned in the interior space;

a transceiver attached to the housing and positioned in the interior space;

a plurality of motors attached to the housing, positioned in the interior space, and being operationally engaged to the plurality of wheels;

a controller attached to the housing, positioned in the interior space, and being operationally engaged to the microprocessor and the plurality of motors; and a microprocessor attached to the housing, positioned in the interior space, and being operationally engaged to the battery, the controller, and the transceiver; and a remote control unit communicatively engaged to the microprocessor via the transceiver and being configured to allow a user to communicate directional commands to the microprocessor, positioning the microprocessor to actuate the controller to selectively actuate the plurality of motors to position the housing on the surface.

16. The convertible bar and table assembly of claim 1, further including:

a battery attached to the housing and positioned in the interior space; and a wireless phone charger attached to the top of the housing and operationally engaged to the battery to wirelessly charge of a phone.

17. A convertible bar and table system comprising the convertible bar and table assembly of claim 1, and:

a plurality of articles of stemware positioned in the slots of the stemware rack;

a display rack attached to the second plate;

at least one bottle attached to the display rack;

a tilt out cabinet pivotally attached to the housing, such that the tilt out cabinet is selectively positionable in a stowed position, wherein the tilt out cabinet is positioned within the interior space, and a deployed position, wherein the tilt out cabinet extends angularly from a cutout positioned in a respective opposed end of the housing; and a plurality of bottles stowed in the tilt out cabinet.

18. A convertible bar and table assembly comprising:

a housing defining an interior space, the housing being elongate cuboid shaped, wherein the housing is configured to function as a coffee table, a top of the housing having an opening positioned therein, the opening being centered between opposed ends of the housing;

a first plate hingedly attached to a rear of the housing adjacent to the top, such that the first plate is hingable between a stowed configuration, wherein the first plate covers the opening, and a deployed configuration, wherein the first plate extends from the housing substantially coplanarly with the rear;

an actuator attached to the housing, positioned in the interior space, and operationally engaged to the first plate;

a stemware rack pivotally attached to the first plate distal from the rear, wherein the stemware rack is configured for insertion of bases of items of stemware, such that the items of stemware pivot concurrently with hinging of the first plate;

a bucket attached to the first plate distal from the rear and being configured to hold ice with the first plate being positioned in the deployed configuration;

a lid hingedly attached to the bucket to close an open top of the bucket;

a pair of arms attached to the first plate distal from the rear:

an elongate housing rotationally attached to and extending between the arms of the pair of arms, a lower facet of the elongate housing comprising the stemware rack;

a panel attached to the elongate housing and defining a compartment within an internal space defined by the elongate housing, the compartment extending along an upper facet of the elongate housing;

a second plate attached to and extending perpendicularly from the first plate proximate to the rear of the housing, such that the second plate substantially covers the opening with the first plate in the deployed configuration;

a display rack attached to the second plate and being configured to display at least one bottle;

a tilt out cabinet pivotally attached to the housing, such that the tilt out cabinet is selectively positionable in a stowed position, wherein the tilt out cabinet is positioned within the interior space, and a deployed position, wherein the tilt out cabinet extends angularly from a cutout positioned in a respective opposed end of the housing, wherein the tilt out cabinet is configured to store a plurality of bottles;

a plurality of bulbs attached to the stemware rack and being configured to selectively illuminate the items of stemware, the plurality of bulbs comprising:

a light emitting diode tube positioned in the compartment, wherein the light emitting diode tube is configured to emit light through a plurality of holes positioned in the panel, each hole of the plurality of holes being aligned with a respective slot of the stemware rack, such that light passing through the hole illuminates an item of stemware positioned in the respective slot;

display light emitting diodes attached to the second plate beneath the display rack, wherein the display light emitting diodes are configured to project light upwardly to illuminate the bottle positioned in the display rack; and a light emitting diode strip attached to the housing and positioned in a recess extending circumferentially around the housing adjacent to a bottom of the housing;

a battery attached to the housing and positioned in the interior space;

an outlet attached to the housing and operationally engaged to the battery for powering auxiliary devices;

a plurality of speakers attached to the housing;

a transceiver attached to the housing and positioned in the interior space;

a microprocessor attached to the housing, positioned in the interior space, and being operationally engaged to the battery, the plurality of bulbs, the plurality of speakers, the transceiver, and the actuator, wherein the transceiver is configured to receive an audio signal, positioning the microprocessor for actuating the plurality of speakers to broadcast the audio signal;

a plurality of wheels attached to the bottom of the housing, such that the housing is rollable upon the plurality of wheels to position the housing on a surface;

a plurality of motors attached to the housing, positioned in the interior space, and being operationally engaged to the plurality of wheels;

a controller attached to the housing, positioned in the interior space, and being operationally engaged to the microprocessor and the plurality of motors;

a remote control unit communicatively engaged to the microprocessor via the transceiver being configured to allow a user to communicate positional commands to the microprocessor to selectively actuate the actuator to motivate the first plate between the stowed configuration and the deployed configuration, the remote control unit to communicate lighting commands to the microprocessor to selectively power respective bulbs of the plurality of bulbs, the remote control unit being configured to allow a user to communicate volume commands and selection commands to the microprocessor to control a volume of the plurality of speakers and to select an audio signal to be broadcast by the plurality of speakers, the remote control unit being configured to allow a user to communicate directional commands to the microprocessor, positioning the microprocessor to actuate the controller to selectively actuate the plurality of motors to position the housing on the surface;

a battery attached to the housing and positioned in the interior space; and a wireless phone charger attached to the top of the housing and operationally engaged to the battery to wirelessly charge a phone.

* * * * *